US008957606B2

(12) United States Patent
Sun et al.

(10) Patent No.: US 8,957,606 B2
(45) Date of Patent: Feb. 17, 2015

(54) LIGHTING SYSTEM AND CONTROL METHOD THEREOF

(71) Applicant: Princeton Technology Corporation, New Taipei (TW)

(72) Inventors: Xiao-Liang Sun, New Taipei (TW); Xiao-Ming Wang, New Taipei (TW); Xiao-Bing Deng, New Taipei (TW)

(73) Assignee: Princeton Technology Corporation, New Taipei (TW)

( * ) Notice: Subject to any disclaimer, the term of this patent is extended or adjusted under 35 U.S.C. 154(b) by 0 days.

(21) Appl. No.: 14/045,141

(22) Filed: Oct. 3, 2013

(65) Prior Publication Data

US 2014/0159597 A1 Jun. 12, 2014

(30) Foreign Application Priority Data

Dec. 7, 2012 (CN) ..... 2012 1 0525788

(51) Int. Cl.
*H05B 37/02* (2006.01)
*H05B 33/08* (2006.01)

(52) U.S. Cl.
CPC ..... *H05B 33/0815* (2013.01); *H05B 33/0803* (2013.01)
USPC ..... 315/312; 315/185 R; 315/291

(58) Field of Classification Search
USPC ..... 315/185 R, 209 R, 291, 307, 308, 312
See application file for complete search history.

(56) References Cited

U.S. PATENT DOCUMENTS 7,265,504 B2 * 9/2007 Grant ..... 315/308
7,733,034 B2 * 6/2010 Kotikalapoodi et al. ..... 315/294

* cited by examiner

*Primary Examiner* — Jimmy Vu
(74) *Attorney, Agent, or Firm* — Muncy, Geissler, Olds & Lowe, P.C.

(57) ABSTRACT

A lighting system includes: a rectifier full-wave rectified an AC voltage to generate an output voltage; first and second LED groups connected to each other in series, wherein an input terminal of the first LED group is coupled to the output voltage; first terminals of first and second switches respectively coupled to output terminals of the first and second LED groups; a first resistor having a first terminal connected to the second terminal of the first switch and the second switch and a second terminal connected to a ground voltage; and first and second operational amplifiers having output terminals respectively coupled to control terminals of the first and second switches, and inverting input terminals respectively coupled to the first terminal of the first resistor, and non-inverting input terminals respectively coupled to the first and second reference voltages.

15 Claims, 4 Drawing Sheets

LIGHTING SYSTEM AND CONTROL METHOD THEREOF

CROSS REFERENCE TO RELATED APPLICATION

This Application claims priority of China Patent Application No. 201210525788.9, filed on Dec. 7, 2012, the entirety of which is incorporated by reference herein.

BACKGROUND OF THE INVENTION

1. Field of the Invention

The present invention is related to a lighting system and in particular, to a control method of a lighting system, 2. Description of the Related Art Recently, with a great amount of light-emitting diodes (LEDs) being adopted in lighting systems, more and more LED lighting systems are employing AC power as the power source thereof. Traditionally, when an AC power source for a plurality of LED lighting systems is used, the AC power will be full-wave rectified via a bridge rectifier, and then a rectified voltage will be outputted to the plurality of LED lighting systems.

In order to improve power conversion efficiency, the LED circuits using AC power are turned on gradationally, so that different numbers of LEDs can be turned on by the different input voltages, and the current flowing through the LEDs can be controlled. Different number of LEDs are usually turned on or off by switches; however, instantaneous switching may cause an instantaneous change of current, and may increase the third harmonic (THD) of the current. Also, the instantaneous change of current also induces electromagnetic interference (EMI).

BRIEF SUMMARY OF INVENTION

A detailed description is given in the following embodiments with reference to the accompanying drawings.

An embodiment of a lighting system is disclosed. A lighting system includes: a rectifier, configured to full-wave rectify an AC voltage and generate an output voltage; a first LED group and a second LED group, connected to each other in series, wherein an input terminal of the first LED group is coupled to he output voltage; a first switch having a first terminal coupled to an output terminal of the first LED group; a second switch having a first terminal coupled to an output terminal of the second LED group; a first resistor having a first terminal connected to a second terminal of the first switch and a second terminal of the second switch and a second terminal connected to a ground voltage; a first operational amplifier having an output terminal coupled to a control terminal of the first switch, an inverting input terminal coupled to the first terminal of the first resistor, and a non-inverting input terminal coupled to a first reference voltage; and a second operational amplifier having an output terminal coupled to a control terminal of the second switch, an inverting input terminal coupled to the first terminal of the first resistor, and a non-inverting input terminal coupled to a second reference voltage. The first reference voltage is higher than the ground voltage and the second reference voltage is higher than the first reference voltage.

A control method of a lighting system is also disclosed, wherein the lighting system comprises a rectifier, a first LED group and a second LED group, a first switch and a second switch, and a first operational amplifier and a second operational amplifier. By using the inventive control method, the full-wave rectification is performed on an AC voltage to generate an output voltage, and the output voltage is outputted to the first LED group and the second LED group being connected in series to each other, wherein the first LED group has a first equivalent conduction voltage and is formed by N LEDs connected in series to each other, and the second LED group has a second equivalent conduction voltage and is formed by M LEDs connected in series to each other, wherein N and M are both integers above zero. The first switch and the second switch are turned on when a feedback voltage across a first resistor is lower than a first reference voltage. When the output voltage is higher than the first equivalent conduction voltage, the first LED group is turned on, such that a first current flowing through the first switch to the first resistor is generated, and the first switch is controlled by the first operational amplifier according to the first reference voltage, the by driving the feedback voltage to be lower than or equal to the first reference voltage. When the output voltage is higher than the sum of the first equivalent conduction voltage and the second equivalent conduction voltage, the first LED group and the second LED group are turned on, such that a second current flowing through the second switch to the first resistor is generated, and the second switch is controlled by the second operational amplifier according to a second reference voltage, thereby driving the feedback voltage to be lower than or equal to the second reference voltage, wherein the second reference voltage is higher than the first reference voltage and the first reference voltage is above zero.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
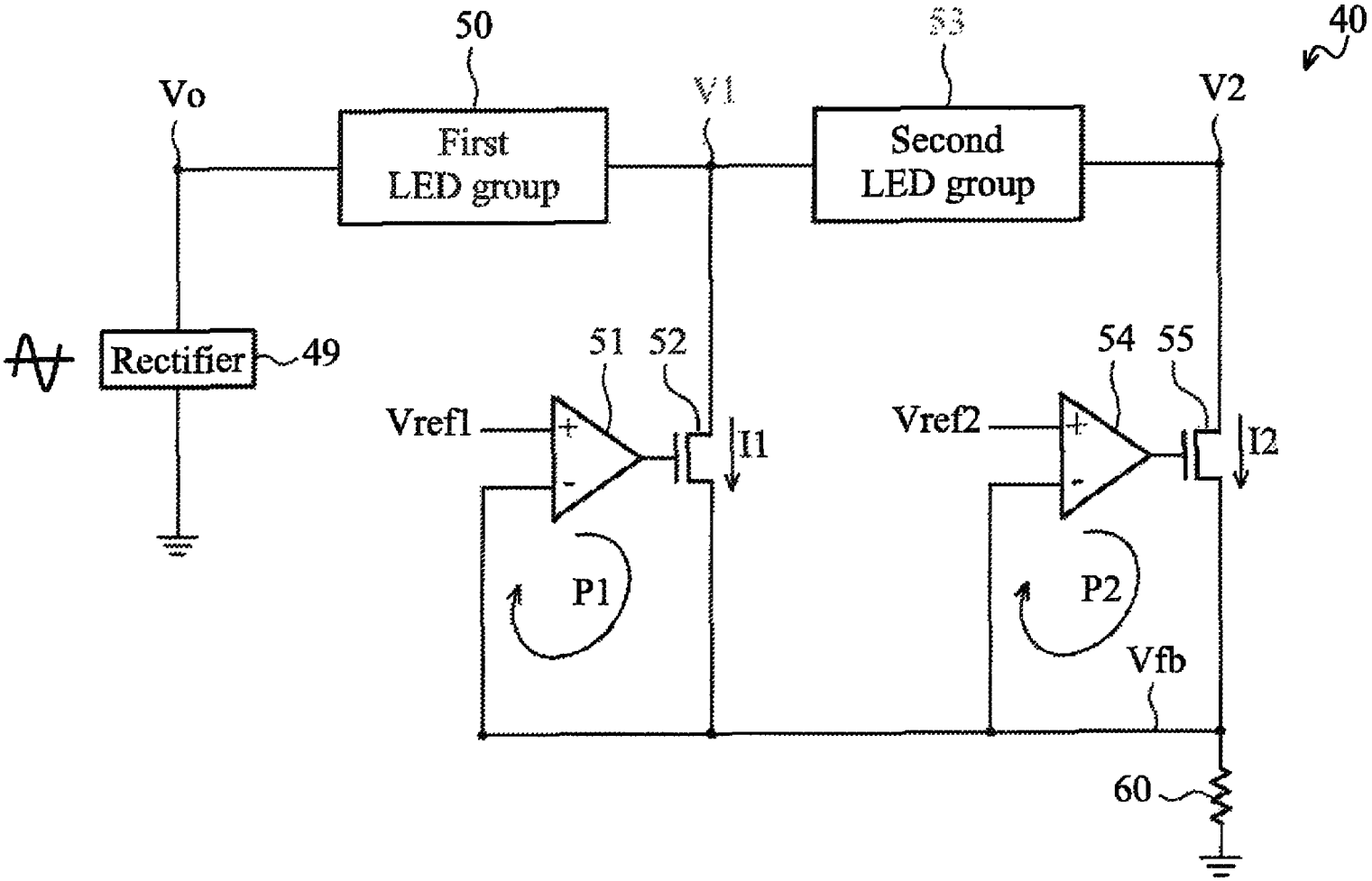
FIG. 1 is a diagram showing an embodiment of a lighting system of the invention.

FIG. 1 is a schematic diagram of a lighting system according to an embodiment of the invention. As shown in FIG. 1, the lighting system 40 includes a rectifier 49, a first LED group 50, a first operational amplifier 51, a first transistor 52, a second LED group 53, a second operational amplifier 54, a second transistor 55 and a resistor 60. The rectifier 49 is configured to perform full-wave rectification on the received AC voltage to generate a half sine-wave output voltage Vo. For example, the rectifier 49 can be a half-wave rectifier, a full wave rectifier or a bridge rectifier, but it is not limited thereto.

The first LED group 50 is formed by N LEDs connected in serial to each other, and has a first equivalent conduction voltage. The second LED group 53 is formed by M LEDs connected in serial to each other, and has a second equivalent conduction voltage. Both N and M are integers and are above zero. In one embodiment, N is equal to M, and the first equivalent conduction voltage is equal to the second equivalent conduction voltage. In alternative embodiments, N is not equal to M, and the first equivalent conduction voltage is not equal to the second equivalent conduction voltage. In one embodiment, the first LED group 50 and the second LED group 53 are formed by connecting the same number of LEDs in serial to each other and have the same equivalent conduction voltage having a voltage level of 90 volts. The first LED group 50 is turned on when the voltage difference between the output voltage Vo at the input of the first LED group 50 and the voltage V1 at the output terminal of the first LED group 50 is higher than 90 volts. Similarly, the second LED group 53 is turned on when the voltage difference between the voltage V1 at the input of the second LED group 53 and the voltage V2 at the output terminal of the second LED groups 53 is higher than 90 volts. The equivalent conduction voltage of the LED groups 50 and 53 can be adjusted according to the AC voltage applied to the rectifier 49 or the number of serially-connected LEDs, but they are not limited thereto.

The first operational amplifier 51 has anon-inverting input terminal coupled to a first reference voltage Vref1, and an inverting input terminal coupled to the resistor 60, wherein a feedback voltage Vfb is generated according to the current flowing through the resistor 60. A negative feedback loop P1 is formed by the first operational amplifier 51, the first transistor 52 and the resistor 60. The current I1 flowing through the first transistor 52 is controlled by the first operational amplifier 51 according to the first reference voltage Vref1 and the feedback voltage Vfb. Similarly, the second operational amplifier 54 has a non-inverting input terminal coupled to a second reference voltage Vref2, and an inverting input terminal is coupled to the resistor 60. Another negative feedback loop P2 is formed by the second operational amplifier 54, the second transistor 55, and a resistor 60. The current I2 flowing through the second transistor 55 is controlled by the second operational amplifier 54 according to the second reference voltage Vref2 and the feedback voltage Vfb. In the embodiment, the second reference voltage Vref2 is higher than the first reference voltage Vref1 and the first reference voltage is higher than zero volts (e.g., ground voltage). In the embodiment, the first transistors 52 and second transistors 55 act as switches, and the first and second transistors 52 and 55 can also be made up of metal-oxide-semiconductor (MOS) transistors, bipolar junction transistors (BJTs), field-effect transistors (FETs), or junction field effect transistors (JFETs), but they are not limited thereto. In alternative embodiments, the first and second operational amplifiers 51 and 54 can be replaced with a comparison unit.

Figure 2A:
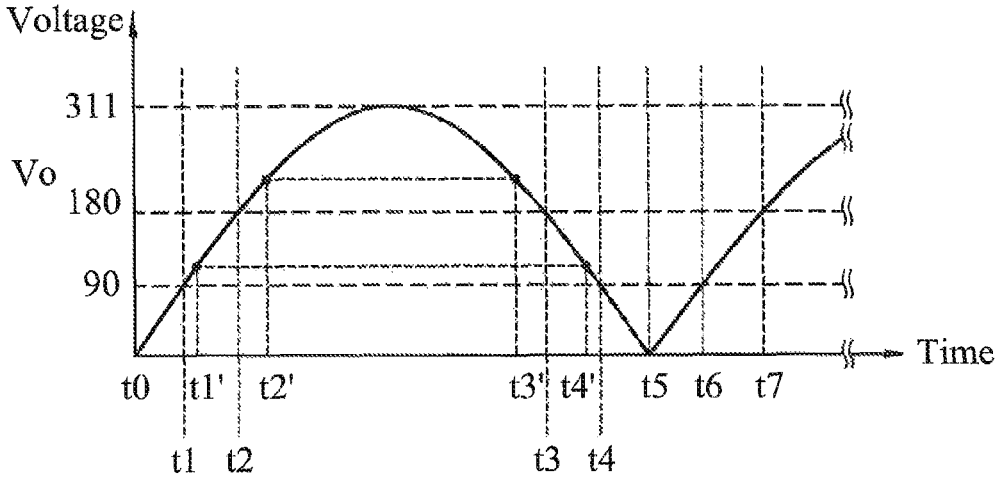
FIG. 2*a* is a timing diagram of a lighting system according to the embodiment of FIG. 1.
Figure 2B:
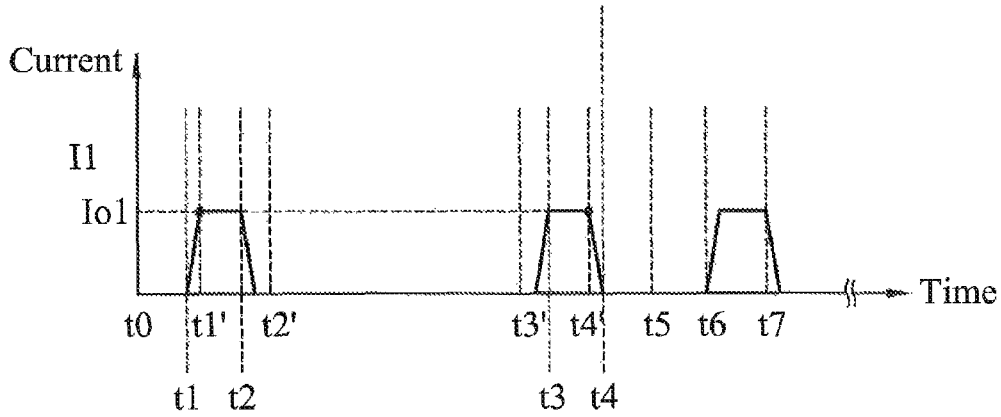
FIG. 2*b* is another timing diagram of a lighting system according to the embodiment of FIG. 1.
Figure 2C:
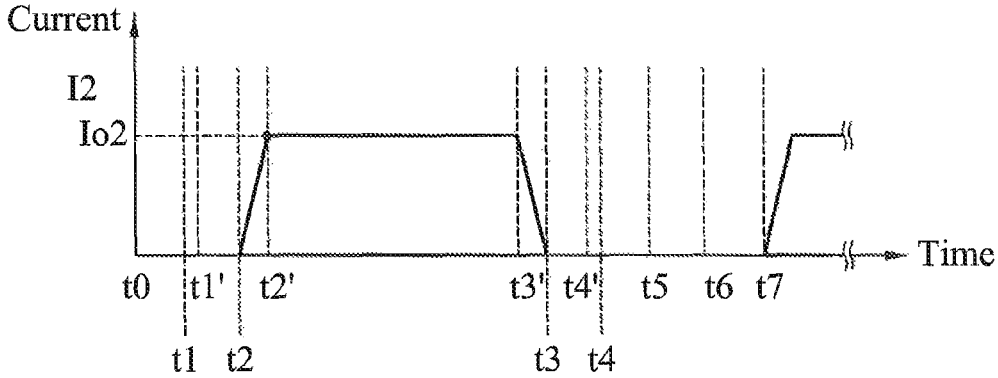
FIG. 2*c* is another timing diagram of a lighting system according to the embodiment of FIG. 1.

FIG. 2*a* to FIG. 2*c* illustrates operation timing diagrams of the lighting system of FIG. 1. FIG. 2*a* illustrates the waveform of the output voltage Vo of the bridge rectifier generated by rectifying the AC voltage. For example, after a 220V AC voltage is full-wave rectified by the rectifier 49, the 220V AC voltage is converted into an output voltage Vo of half sine-wave and the peak voltage of the output voltage Vo is 311 volts. FIG. 2*b* and FIG. 2*c* respectively illustrate the timing diagram of the current I1 flowing through the first transistor 52 and the timing diagram of the current I2 flowing through the second transistor 55 conforming to the timing diagram of the output voltage Vo of FIG. 2*a*.

In one embodiment, the equivalent conduction voltage of the first LED group 50 and the equivalent conduction voltage of the second LED group 53 are 90 volts. When the time travels from t0 to t1, the output voltage Vo is lower than 90 volts. At this time, the output voltage Vo is lower than the first equivalent conduction voltage of the first LED group 50, and the first LED group 50 is turned off and the current flowing through the resistor 60 is zero. Thus, the feedback voltage Vfb on the resistor 60 is zero. Further, since both the first reference voltage Vref1 and the second reference voltage Vref2 are higher than the feedback voltage Vfb, the output voltage Vc1 of the first operational amplifier 51 and the output voltage Vc2 of the second operational amplifier 54 are at a first level (e.g., a high level), such that the first transistor 52 and second transistor 55 are turned on.

When the time travels from t1 to t1', the output voltage Vo is higher than 90 volts. At this time, the voltage difference of the output voltage Vo at the input terminal of the first LED group 50 and the voltage V1 at the output terminal of the first LED group 50 is higher than 90 volts, and the first LED group 50 is turned on such that the current flowing through the first LED group 50 flows through the first transistor 52 to the resistor 60, and a feedback voltage Vfb is generated on the resistor 60. As the output voltage Vo is gradually increased, the current I1 flowing through the first LED group 50 to the first transistor 52 and the resistor 60 also increases such that the feedback voltage Vfb is also increased along with the current flowing through the resistor 60. At the time t1', the negative feedback loop P1 formed by the first operational amplifier 51, the first transistor 52 and the resistor 60 clamps the feedback voltage Vfb which is coupled to the inverting input terminal of the first operational amplifier 51 at a first voltage. At this time, the current flowing through the resistor 60 is a first load current Io1, which is equal to the current value derived by dividing the first voltage by the resistance of the resistor 60. In this embodiment, the first voltage is lower than or equal to the first reference voltage Vref1. For example, when the first operational amplifier 51 is an ideal operational amplifier having an infinite gain, the first voltage is equal to the first reference voltage Vref1.

When the time travels from t2 to t2', the output voltage Vo is higher than 180 volts. At this time, the output voltage Vo is higher than the sum of the first equivalent conduction voltages of the first LED group 50 and the second equivalent conduction voltages of the second LED group 53. Therefore, the first LED group 50 and the second LED group 53 are both turned on, and the current I2 flowing through the second LED group 53 flows through the second transistor 55 to the resistor 60. As the output voltage Vo is gradually increased, the current I1 flowing through the first transistor 52 is gradually decreased from the first load current Io1 to zero, and the first transistor 52 is turned off. Adversely, the current I2 flowing through the second transistor 55 is gradually increased until the current I2 flowing through the second transistor 55 is equal to a second load current Io2.

When the time travels from t2 'to t3', the negative feedback loop P2 formed by the second operational amplifier 54, the second transistor 55 and the resistor 60 clamps the feedback voltage Vfb which is coupled to the inverting input terminal of the second operational amplifier 54, at a second voltage. At this time, the current flowing through the resistor 60 is the second load current Io2, which is equal to the current value derived by dividing the second voltage by the resistance of the resistor 60. In this embodiment, the second voltage is lower than or equal to the second reference voltage Vref2. For example, when the second operational amplifier 54 is an ideal operational amplifier having an infinite gain, the second voltage is equal to the second reference voltage Vref2.

When the time travels from t3' to t3, the output voltage Vo continues to decrease to 180 volts, and the current I2 flowing through the second transistor 54 is gradually decreased from the second load current Io2 to zero. However, the feedback voltage Vfb of the resistor 60 is decreased to the first voltage when the current I2 flowing through the second transistor 54 is decreased and is lower than the first load current Io1. At this time, the first transistor 52 is turned on by the first operational amplifier 51. As the current I2 is decreased, the current I1 flowing through the first transistor 52 is gradually increased until the current I1 flowing through the first transistor 52 is equal to the first load current Io1.

When the time travels from t3 to t4', the output voltage Vo is lower an 180 volts. Thus, the output voltage Vo is lower than the sum of the first equivalent conduction voltage of the first LED group 50 and the second equivalent conduction voltage of the second LED group 53, but is higher than the first equivalent conduction voltage of the first LED group 50. Therefore, the first LED group 50 continues to turn on, and the second LED group 53 is turned off. The negative feedback circuit P1 formed by the first operational amplifier 51, the first transistor 52 and the resistor 60 clamps the current flowing through the resistor 60 at the first load current Io1.

When the time travels from t4' to t4, the output voltage Vo continues to decrease to 90 volts. Thus, the current I1 flowing through the first transistor 52 is gradually decreased from the first load current Io1 to zero. The first operational amplifier 51 continues to turn on the first transistor 52 as the feedback voltage Vfb is lower than the first reference voltage Vref1.

When the time travels from t4 to t5, since the output voltage Vo is lower than 90 volts, the first LED group 50 and the second LED group 53 are both turned off such that the current is zero. The first transistor 52 and the second transistor 55 are turned on. Because output voltage Vo is a periodic half-sine wave, the lighting system 40 periodically repeats the foregoing procedure, of which detailed descriptions are omitted for brevity. In the present embodiment, since the feedback voltage Vfb is not higher than the second reference voltage Vref2, the second transistor 55 is turned on by the second operational amplifier 54 during the time period of t0 to t5.

From the operation tuning diagrams of FIG. 2*a* to FIG. 2*c*, it can be realized that the current flowing through the transistor will not instantly change, but gradually increase or reduce, regardless of Whether the transistor is turned on or off. For example, as show in FIG. 2*b*, during the time period of t1 to t1', the current I1 flowing through the first transistor is gradually increased from zero to a first load current Io1 as the output voltage Vo is increased. Similarly, during the time period of t2 to t2', the current I1 flowing through the first transistor 52 is gradually decreased from a first load current Io1 to zero as the output voltage Vo is increased.

Figure 3:
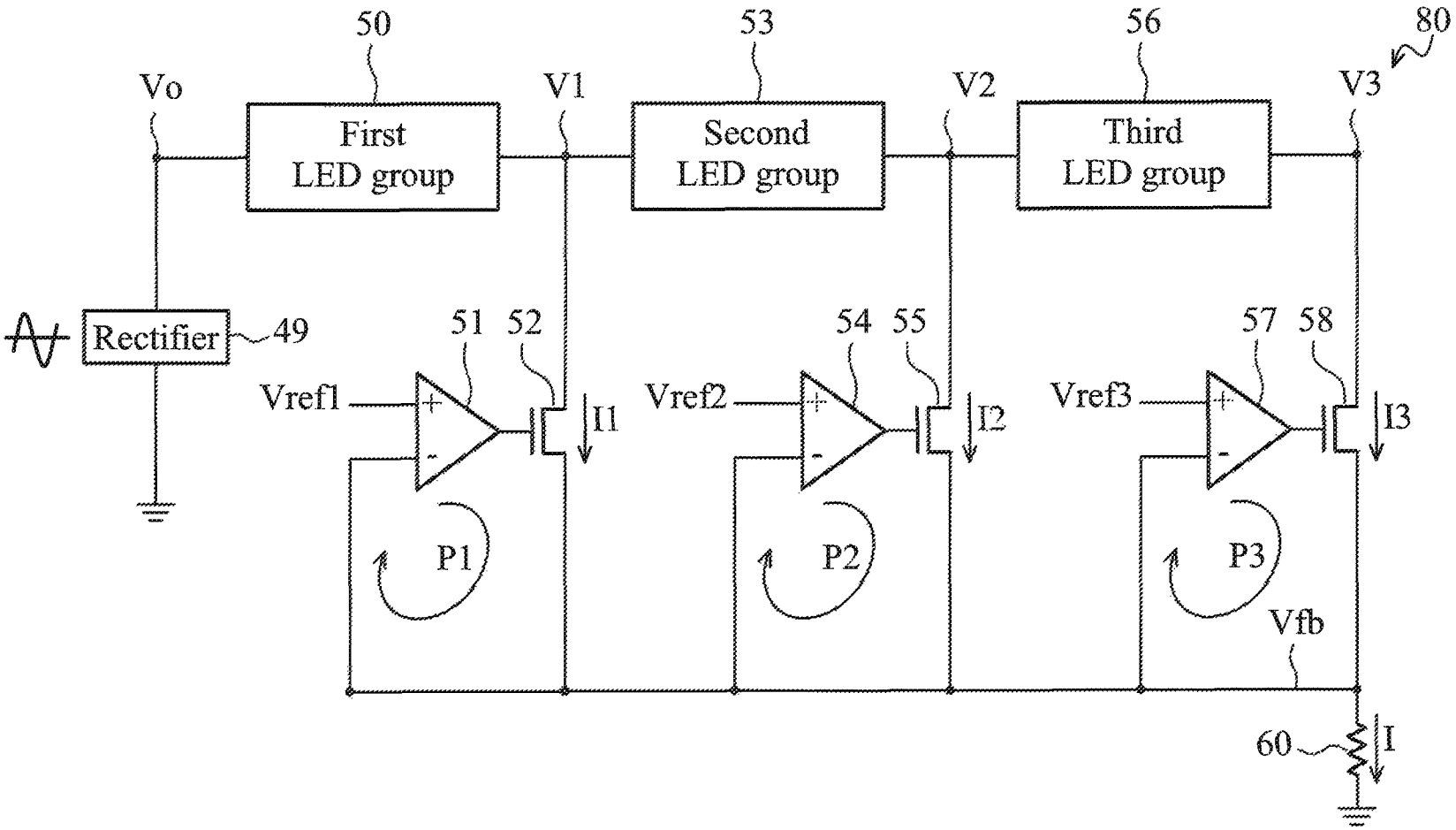
FIG. 3 is another diagram of the lighting system of the invention according to another embodiment of the invention.

FIG. 3 is another embodiment according to the present disclosure. As shown in FIG. 3, the lighting system 80 is similar to the lighting system shown in FIG. 1. The difference between the circuitry of FIG. 1 and the circuitry of FIG. 3 is that the lighting system 80 of FIG. 3 further comprises a third LED group 56, a third operational amplifier 57 and a third transistor 58. The third LED group 56 has a third equivalent conduction voltage. Also, a non-inverting input terminal of the third operational amplifier 57 is coupled to the third reference voltage Vref3, and the third reference voltage Vref3 is higher than the second reference voltage Vref2.

Figure 4:
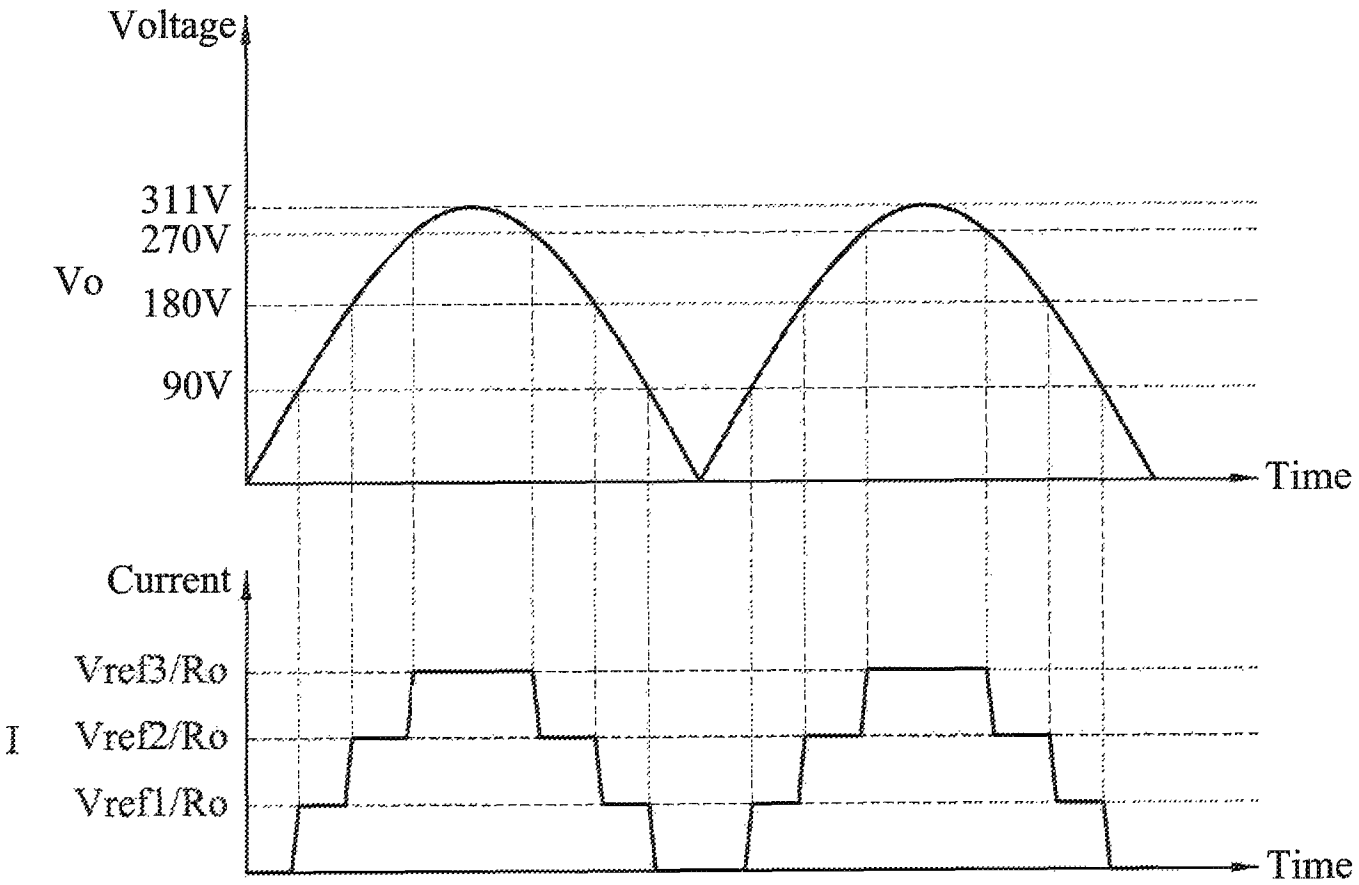
FIG. 4 is another timing diagram of a lighting system according to embodiment of FIG. 3.

FIG. 4 is an operation timing diagram illustrating the operation of the lighting system 80 of FIG. 3. The upper portion of FIG. 4 shows the waveform of the output voltage Vo of the rectifier 49. The lower portion of FIG. 4 shows the waveform of the current I flowing through the resistor 60 and the waveform of the output voltage Vo of the lighting system 80 of FIG. 3. Further, for the sake of explanation, the first operational amplifier 51, the second operational amplifier 54, and the third operational amplifier 57 in FIG. 3 are considered as ideal amplifiers having an infinite gain, and the equivalent conduction voltage of the first LED group 50, the equivalent conduction voltage of the second LED group 53, and the equivalent conduction voltage of the third LED group 56 are all 90 volts. In addition, the transient processes of the switching operation of the first, second, and the third transistors have been elaborated in the preceding paragraph concerning the operation during the periods of t1 to t1', t2 to t2', t3' to t3 and t4' to t4 of FIG. 2, and thus the details thereof are omitted for brevity.

As shown in FIG. 4, when the output voltage Vo is lower than 90 volts, the first LED group 50 is turned off and the current I flowing through the resistor 60 is equal to zero. When the output voltage Vo is between 90 to 180 volts, the first LED group 50 is turned on, and the negative feedback loop P1 is formed by the first operational amplifier 51, the first transistor 52 and the resistor 60. Thus, the feedback voltage Vfb is clamped at the first reference voltage Vref1, and the current I flowing through the resistor 60 is equal to the current value derived by dividing the first reference voltage Vref1 by the resistance Ro of the resistor 60.

When the output voltage Vo is between 180 to 270 volts, the second LED group 53 and the second transistor 55 are turned on, and the first transistor 52 is turned off. Further, a negative back feedback loop P2 formed by the second operational amplifier 54, the second transistor 55 and the resistor 60 clamps the feedback voltage Vfb to be equal to the second reference voltage Vref2, such that the current I flowing through the resistor 60 is equal to the current value derived by dividing the second reference voltage Vref2 by the resistance value Ro of the resistor 60.

When the output voltage Vo is between 270 to 311 volts, the third LED groups 56 and the third transistor 58 are turned on, and the second transistor 55 is turned off. Further, a negative back feedback loop P3 is formed by the third operational amplifier 57, the third transistor 58 and the resistor 60. The negative back feedback, loop P3 is able to clamp the feedback voltage Vfb to be equal to the third reference voltage Vref3, such that the current I flowing through the resistor 60 is equal to the current value derived by dividing the third reference voltage Vref3 by the resistance Ro of the resistor 60.

In the exemplary embodiment of the present invention, an LED group, an operational amplifier and a transistor can be considered as an LED control circuit. In alternative embodiments, the lighting system can be formed by connecting more LED group control circuits in series with each other in order to improve the power conversion efficiency. For example, four or five groups of the LED control circuits can be connected in series to form the lighting system, but is not limited thereto.

In the inventive lighting system, no instant current change is generated when the transistors 51, 54 and 57 are turned on or off In this manner, the waveform of the current flowing through the LEDs in the AC-driven LED groups is smoother when the LED groups are gradationally turned on or off. Thus, the third harmonic effect is reduced and the lower electromagnetic interference, is obtained.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lighting system, comprising:

a rectifier, configured to perform full-wave rectification on an alternating current (AC) voltage to generate an output voltage;

a first light emitting diode (LED) group and a second light emitting diode (LED) group connected in series to each other, wherein an input terminal of the first LED group is coupled to the output voltage;

a first switch, having a first terminal coupled to an output terminal of the first LED group;

a second switch, having a first terminal coupled to an output terminal of the second LED group;

a first resistor, having a first terminal coupled to a second terminal of the first switch and a second terminal, of the second switch, and a second terminal coupled to a ground voltage;

a first operational amplifier, having an output terminal coupled to a control terminal of the first switch, and an inverting input terminal coupled to the first terminal of the first resistor, and a non-inverting input terminal coupled to a first reference voltage; and a second operational amplifier, having an output terminal coupled to a control terminal of the second switch, and an inverting input terminal coupled to the first terminal of the first resistor, and a non-inverting input terminal coupled to a second reference voltage, wherein the first reference voltage is higher than the ground voltage and the second reference voltage is higher than the first reference voltage.

2. The lighting system as claimed in claim 1, wherein the first operational amplifier and the second operational amplifier respectively turn on the first switch and the second switch when a feedback voltage generated at the first terminal of the first resistor is lower than the first voltage, and wherein the first operational amplifier turns off the first switch and the second operational amplifier turns on. the second switch when the feedback voltage is higher than the first reference voltage but is lower than the second reference voltage.

3. The lighting system as claimed in claim 1, further comprising:

a third LED group, having and an input terminal coupled to the output terminal of the second LED group;

a third switch, having a first terminal coupled to an output terminal of the third LED group, and a second terminal coupled to the first terminal of the first resistor; and a third operational amplifier, having an output terminal coupled to a control terminal of the third switch, and an inverting input terminal coupled to the first terminal of the first resistor, and a non-inverting input terminal coupled to a third reference voltage, wherein the third reference voltage is higher than the second reference voltage.

4. The lighting system as claimed in claim 3, wherein:

the first operational amplifier, the second operational amplifier and the third operational amplifier respectively turn on the first switch, the second switch and the third switch when the feedback voltage is lower than the first reference voltage;

when the feedback voltage is higher than the first reference voltage but is lower than the second reference voltage, the first operational amplifier turns off the first switch but the second operational amplifier and the third operational amplifier respectively turn on the second switch and the third switch; and when the feedback voltage is higher than the second reference voltage but is lower than the third reference voltage, the first operational amplifier and the second operational amplifier respectively turn off the first switch and the second switch but the third operational amplifier turns on the third switch.

5. The lighting system as claimed in claim 1, wherein the rectifier is a bridge rectifier.

6. The lighting system as claimed in claim 1, wherein the first LED group is formed by connecting N LEDs in series with each other and has a first equivalent conduction voltage, and the second LED group is formed by connecting M LEDs in series with each other and has a second equivalent conduction voltage, wherein N and M are integers and are above zero.

7. The lighting system aimed in claim 6, wherein N is not equal to M and the first equivalent conduction voltage is not equal to the second equivalent conduction voltage.

8. The lighting system as claimed in claim 6, wherein N is equal to M and the first equivalent conduction voltage is equal to the second equivalent conduction voltage.

9. The lighting system as claimed in claim 6, wherein when the output voltage is higher than the first equivalent conduction voltage and is lower than a sum of the first equivalent conduction voltage and the second equivalent conduction voltage, the first LED group is turned on such that a first feedback loop formed by the first switch and the first operational amplifier and the first resistor clamps the feedback voltage to be lower than or equal to the first reference voltage.

10. The lighting system as claimed in claim 9, wherein when the output voltage is higher than the sum of the first equivalent conduction voltage and the second equivalent conduction voltage, the first LED group and the second LED group are turned on such that a second feedback loop formed by the second switch and the second operational amplifier and the first resistor clamps the feedback voltage to be lower than or equal to the second reference voltage.

11. A control method of a lighting system, wherein the lighting system comprises a rectifier, a first LED group and a second LED group, a first switch and a second switch, and a first operational amplifier and a second operational amplifier, the control method comprising the steps of:

performing full-wave rectification on an AC voltage to generate an output voltage;

outputting the output voltage to the the first LED group and the second LED group connected in series with each other, wherein the first LED group has a first equivalent conduction voltage and is formed by connecting N LEDs in series with each other, and the second LED group has a second equivalent conduction voltage and is formed by connecting M LEDs in series with each other, wherein N and M are integers above zero;

turning on the first switch and the second switch, when a feedback voltage across a first resistor is lower than a first reference voltage;

when the output voltage is higher than the first equivalent conduction voltage, turning on the first LED group and generating a first current flowing through the first switch to the first resistor, and controlling the first switch by the first operational amplifier according to the first reference voltage, such that the feedback voltage is lower than or equal to the first reference voltage; and when the output voltage is higher than a sum of the first equivalent conduction voltage and the second equivalent conduction voltage, turning on the first LED group and the second LED group and generating a second current flowing through the second switch to the first resistor, and controlling the second switch by the second operational amplifier according to a second reference voltage, such that the feedback voltage is lower than or equal to the second reference voltage, wherein the second reference voltage is higher than the first reference voltage, and the first reference voltage is higher than zero.

12. The control method as claimed in claim 11, wherein the first operational amplifier gradually turns off the first switch as the second current is increased when the first LED group and the second LED group are turned on.

13. The control method as claimed in claim 11, wherein the lighting system further comprises a third LED group, a third switch and a third operational amplifier, and the third LED group has a third equivalent conduction voltage and is formed by connecting X LEDs in series with each other, and X is and an integer and is above zero, the control method further comprising the steps of:

turning on the first switch, the second switch and the third switch when the feedback voltage is lower than a first reference voltage; and when the output voltage is higher than the sum of the first equivalent conduction voltage, the second equivalent conduction voltage and third equivalent conduction voltage, turning on the first LED group, the second LED group and the third LED groups and generating a third current flowing through the third switch to the first resistor, and controlling the third switch by the third operational amplifier according to a third reference voltage, such that the feedback voltage is lower than or equal to the third reference voltage, wherein the third reference voltage is higher than the second reference voltage,

14. The control method as claimed in claim 13, wherein the second operational amplifier gradually turns off the second switch as the third current is increased when the first LED group, the second LED group and the third LED group are turned on.

15. The control method as claimed in claim 11, wherein the rectifier is a bridge rectifier.

* * * * *